United States Patent [19]

Menz et al.

[11] Patent Number: 5,050,503

[45] Date of Patent: Sep. 24, 1991

[54] SELECTIVELY AIMABLE WARHEAD INITIATION SYSTEM

[75] Inventors: Fred L. Menz; Michael R. Osburn, both of China Lake; Jerry O. Jones, Ventura, all of Calif.

[73] Assignee: The United States of America as represented by the Secretary of the Navy, Washington, D.C.

[21] Appl. No.: 182,196

[22] Filed: Sep. 20, 1971

[51] Int. Cl.[5] ..... F42B 12/20

[52] U.S. Cl. ..... 102/475; 102/200; 102/275.9; 102/701

[58] Field of Search ..... 102/56, 67, DIG. 2, 102/200, 215, 275.9, 305, 475, 700

[56] References Cited

U.S. PATENT DOCUMENTS

| | | | |
|---|---|---|---|
| 3,430,564 | 3/1969 | Silvia et al. | 102/DIG. 2 |
| 3,565,009 | 2/1971 | Allred | 102/56 |
| 3,661,088 | 5/1972 | Han et al. | 102/56 X |

*Primary Examiner*—Harold J. Tudor

*Attorney, Agent, or Firm*—Harvey A. Gilbert; Melvin J. Sliwka; Sol Sheinbein

[57] ABSTRACT

A system for aiming a selectively aimable warhead (SAW) at a target by explosively deforming the warhead into a shape desirable for directionality. Twenty-four explosive forming charges are located around the circumference of the warhead and run the entire length of the warhead. The proximity fuze selects one sector out of 24 as the direction aim. Having selected a sector in the azimuth, the forming charge in that sector plus the adjacent two forming charges are initiated simultaneously. After a time delay interval sufficient to allow the warhead to deform (about ½ millisecond to 1 millisecond), warhead boosters located furthest from the target (or 180 degrees from the forming charges) and on each end of the warhead, are initiated simultaneously. The warhead is detonated generating a high velocity fragment beam towards the target.

3 Claims, 9 Drawing Sheets

SELECTIVELY AIMABLE WARHEAD INITIATION SYSTEM

BACKGROUND OF THE INVENTION

This invention relates to systems for initiating selectively aimable warheads.

Safety requirements necessitate that each detonator in a SAW be safed and armed. A SAW with 24 azimuthal sectors of aiming resolution and one mode for isotrophic warhead initiation would, therefore, require 25 detonators to be safed and armed. The use of this number of detonators would prove untenable due to their bulkiness and cost.

The present invention employs a explosive logic network whose binary sequencing input signals require only 5 detonators to be safed and armed. The present invention appears to be the only practical approach to solving the problems associated with initiating a selectively aimable warhead system.

SUMMARY OF THE INVENTION

The present invention explosively deforms a selectively aimable warhead into a shape desirable for directionability. Explosive forming charges are located around the circumference of the warhead and around the length of the warhead. A target detecting device selects one of a plurality of sectors as the direction of aim. Having selected a sector in the azimuth, the forming charge in that sector and its two nearest neighbors are initiated simultaneously. After a time interval sufficient to allow the warhead to deform, warhead boosters at each end of the warhead furthest from the target or 180 degrees from the forming charges are initiated simultaneously.

Detonation of the forming charges produces a large vane aimed at the target. Warhead detonation generates a high velocity fragment beam towards the target.

Present safety regulations require each detonator to be safed and armed. When as many as 24 azimuthal sectors of aiming resolution are required for a selectively aimable warhead, the employment of 24 detonators and at least 24 delay detonators are required with conventional fuzing methods. This proves to be undesirable.

The present invention employs an explosive logic network. Binary sequencing input signals to the explosive logic network require only five detonators to be safed and armed. The explosive logic system of the present invention can be packaged in a relatively small volume and be fabricated and loaded at relatively low cost.

DESCRIPTION OF THE PREFERRED EMBODIMENT

Figure 1:
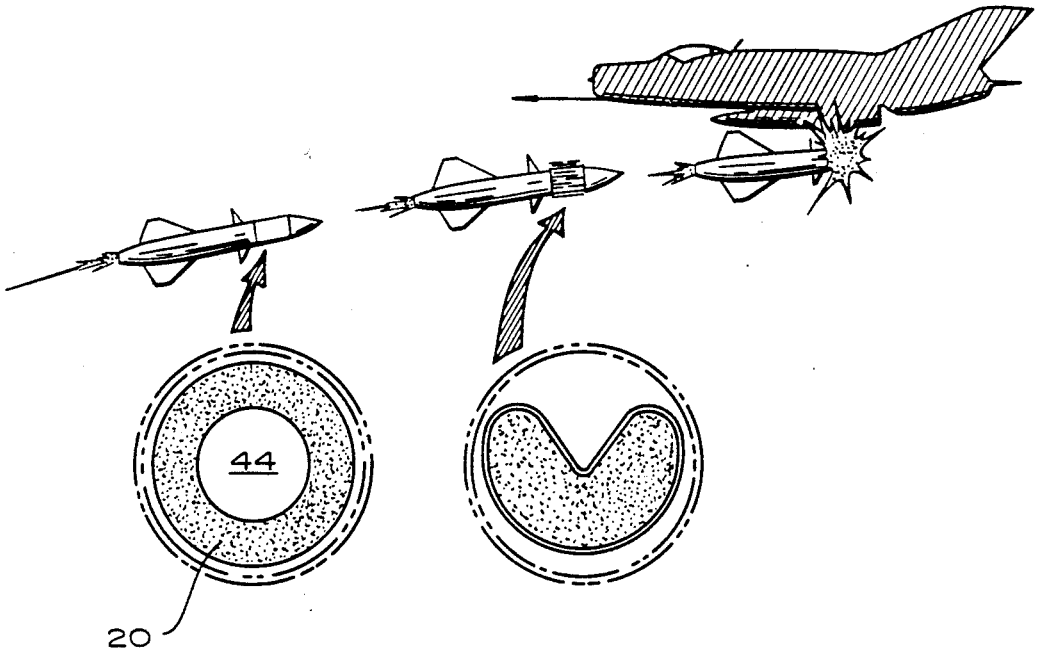
FIG. 1 shows the operational sequence of a selectively aimable warhead encounter.
Figure 2:
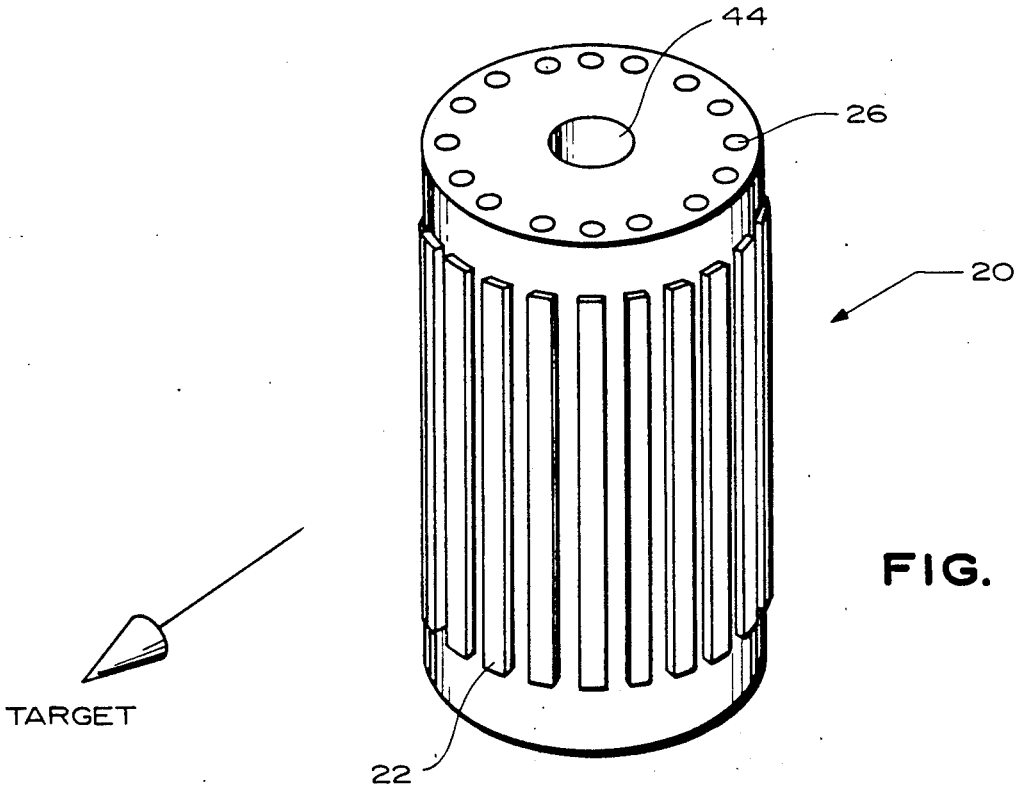
FIG. 2 shows a selectively aimable warhead prior to deformation.

FIG. 2 shows a cylindrical, selectively aimable warhead 20 surrounded by twenty-four evenly spaced forming charges 22 running parallel to the axis of the selectively aimable warhead (SAW). At each end of the SAW are twenty-four (24) booster charges 26. Each booster charge 26 is associated with a forming charge 22 in a position diametrically opposite of the booster charge.

Figure 3:
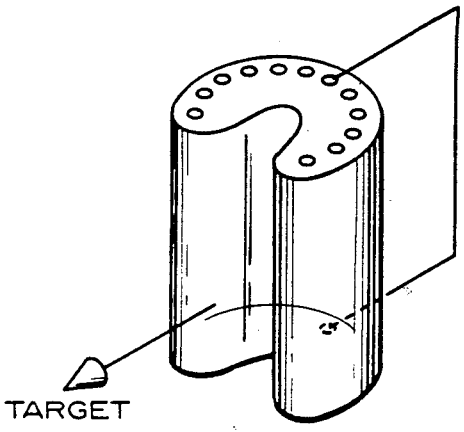
FIG. 3 shows a selectively aimable warhead after forming charge detonation.

In order to aim the warhead in the direction of a target, the forming charge next to the target along with the two nearest neighbors of the forming charge are detonated, thereby producing a large vane aimed at the target as shown in FIG. 3. After a delay of from ½ to 1 millisecond the boosters directly opposite the target are detonated, thereby detonating the SAW and generating a high velocity fragment beam towards the target.

Figure 11:
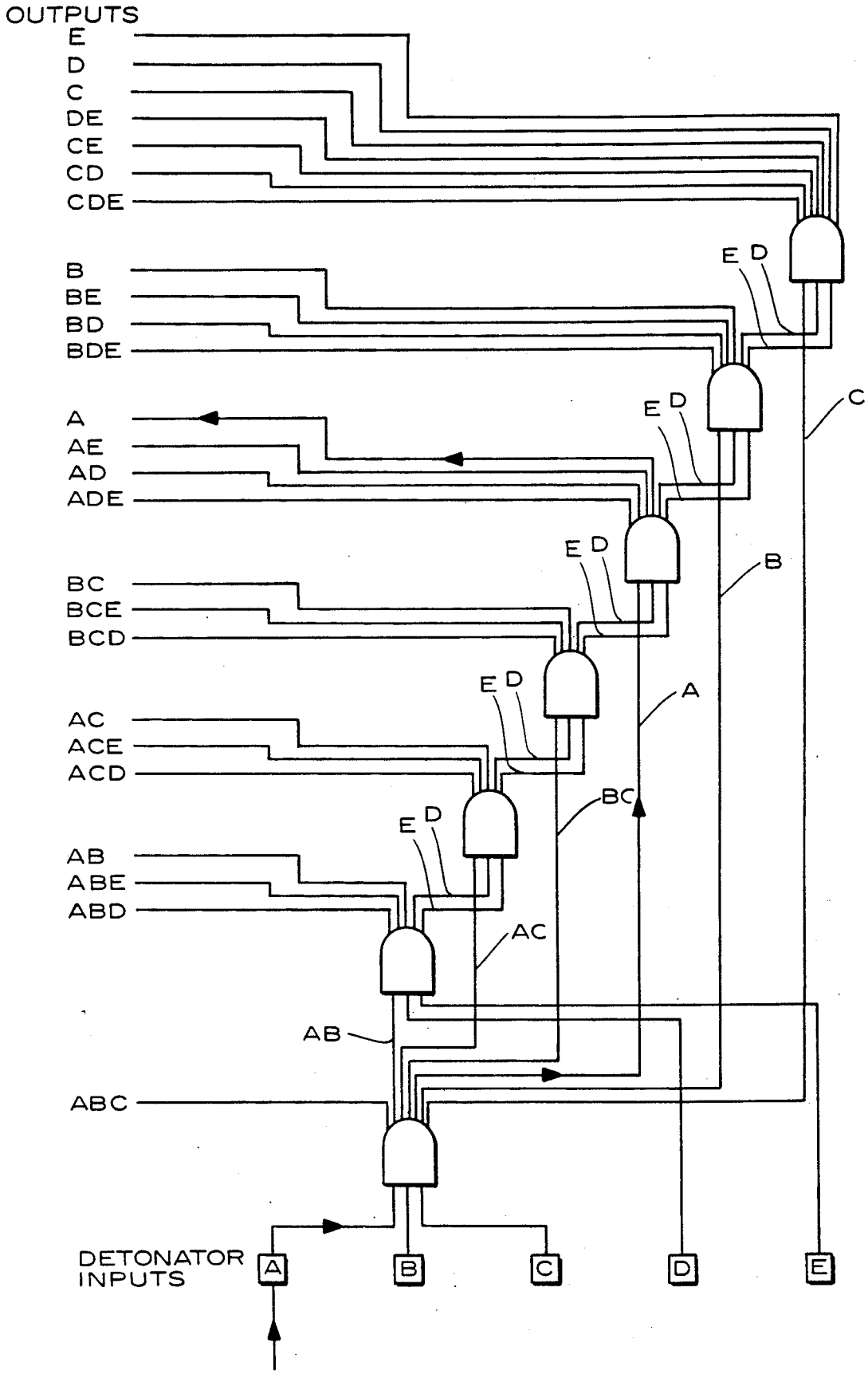
FIG. 11 shows a symbolic representation of the explosive logic network of the present invention.

In order to initiate any one of the twenty-five (25) modes of the SAW initiating system by using only five detonator inputs, the invention employs an explosive binary logic network as shown in FIG. 11.

To perform these functions explosively, this invention uses the "corner effect" as described in the patent to Silvia et al., U.S. Pat. No. 3,496,868, dated Feb. 24, 1970.

Figure 4:
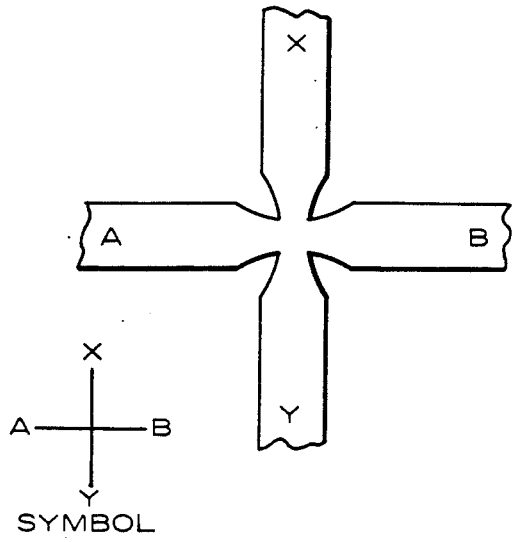
FIG. 4 shows a destructive crossover of an explosive trail and the symbol therefor.

An example of the corner effect is seen in the destructive crossover of FIG. 4. In this destructive crossover, an explosive reaction starting at A will propagate to B without turning the corner at the intersection and traveling to x or y. Having crossed the intersection it will also have severed the path from x to y thereby preventing subsequent transfer between these points. This element allows an explosive reaction in either direction along either path while allowing only the reaction which arrives at the intersection first to be transmitted across the intersection.

Figure 5:
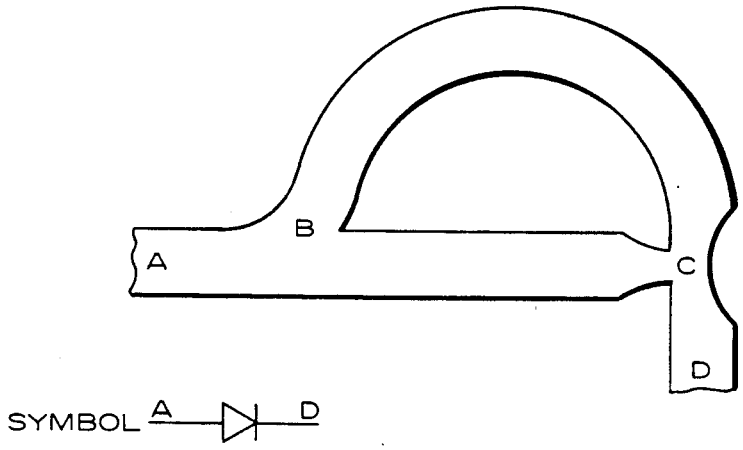
FIG. 5 shows an explosive diode and the symbol therefor.

A further use of the corner effect is seen in its employment in an explosive diode as shown in FIG. 5. An explosive diode works like its electronic counterpart in that the reaction is only allowed to pass in one direction. If the reaction starts at A, it travels to B where it branches. The straight path from B to C is shorter and therefore arrives at C first, thereby severing the path to D without turning the corner. When the reaction following the curved path arrives at C it is unable to pass through the junction and, thus, stops. Thus an explosive reaction started at A will never reach D. However, a reaction starting at D proceeds along the curved path to A without being impeded.

Figure 6:
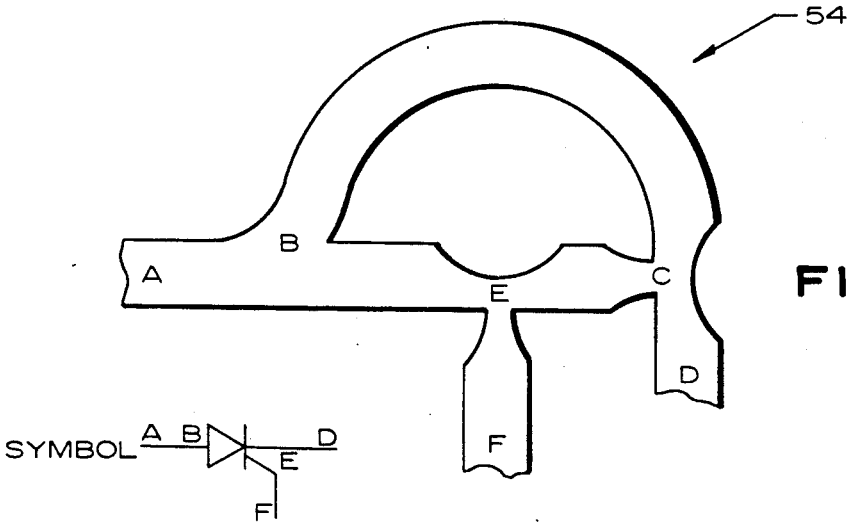
FIG. 6 shows an explosive controlled rectifier and the symbol therefor.

An explosive diode is used as a building block for an explosive control rectifier as shown in FIG. 6. The explosive controlled rectifier is similar to the electronic counterpart except that unlike its electronic counterpart it does not perform a "blocking" function in the reverse direction.

Physically the explosive controlled rectifier is constructed like the diode but with one additional path from F to E. Starting the reaction at A, it acts like the diode in that it will be stopped at C. However, if F is initiated first, it propagates up and severs the path from B to C at E. Consequently, when the reaction is started at A it proceeds to B and branches. The straight leg is stopped at E and the curved portion is allowed to proceed to D. Thus, for a reaction to propagate from A to D, the rectifier must have previously been "gated" by initiating F.

Figure 7:
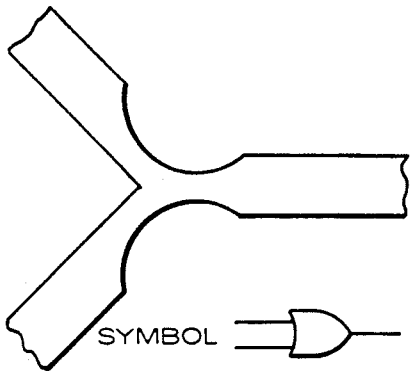
FIG. 7 shows an OR logic element and symbol therefor.
Figure 8:
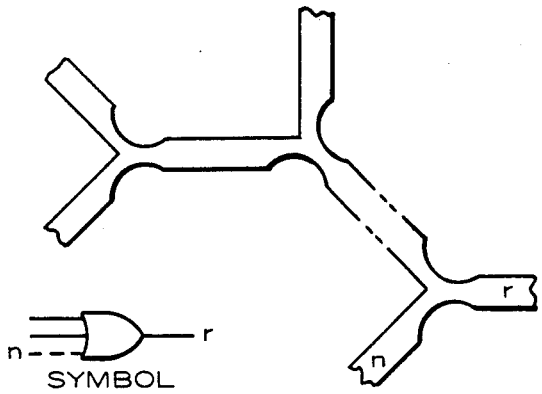
FIG. 8 shows a multi-input (OR) logic element.

In FIG. 7 is seen an explosive OR element and the symbol therefor. A detonation wave coming from the left along either the upper or lower branch will turn the corner and continue to the right but will not turn the corner and go back to the left along the one of the other branches. A similar OR element is shown at FIG. 8. This is a multi-input OR element and which an input may come from any of the n branches and continue to r without going back through any of the other branches.

Figure 9A:
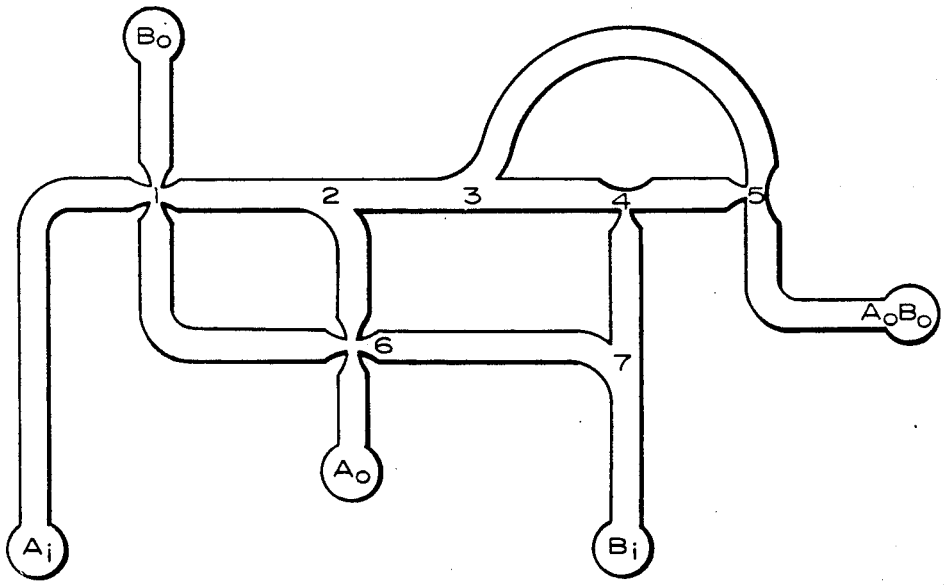
FIG. 9*a* shows the explosive paths of an AND/-NAND logic element.
Figure 9B:
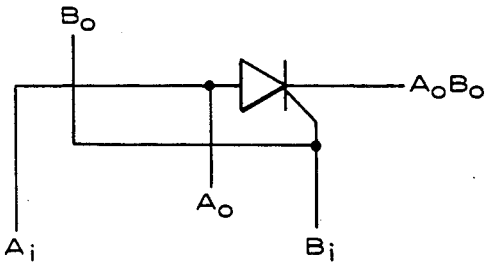
FIG. 9*b* shows a schematic representation of an AND/NAND logic element.
Figure 9C:
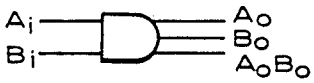
FIG. 9*c* shows a symbolic representation of an AND/NAND logic element.

By utilizing the explosive controlled rectifier and the destructive crossover, an AND/NAND logic element as shown in FIGS. 9a–9c, may be constructed.

With the AND/NAND logic element of FIGS. 9a–9c it is possible to derive three distinct outputs from two distinct inputs. For example, assume that inputs are received at $A_i$ and $B_i$ simultaneously. The reaction started at $A_i$ proceeds to 1, a destructive crossover, and propagates across, thus severing the path leading to $B_o$. The reaction continues on, branching at 2, to 3 and 6. During this period the reaction started at $B_i$ has traveled to 7, branched to 4 and 6, and arrived at the destructive crossover at 6 prior to the arrival of the reaction started at $A_i$. Thus the reaction coming from 2 to 6 is stopped at 6. Also, the path from 6 to $B_o$ has been severed at 1. Meanwhile, at 4, the reaction from $B_i$ has arrived prior to the reaction from $A_i$. The path from 3 to 5 is, therefore, severed. When the reaction from $A_i$ reaches 3, it follows the curved path leading to 5 and on to the desired $A_o$ $B_o$ output.

If a reaction is started only at $A_i$, the reaction travels across the destructive crossover at 1 and branches at 2. It continues on to 3, 4 and 5, thus severing the path to $A_o$ $B_o$. The second branch at 2 travels to 6 and onto $A_o$.

In a similar manner, a reaction started at $B_i$ travels to 7 where it branches to 4 and 6. The reaction ceases at 4, but continues from 6 to 1 and onto $B_o$.

It is thus seen that with the AND/NAND logic element, two inputs may be used to obtain three outputs.

Figure 10:
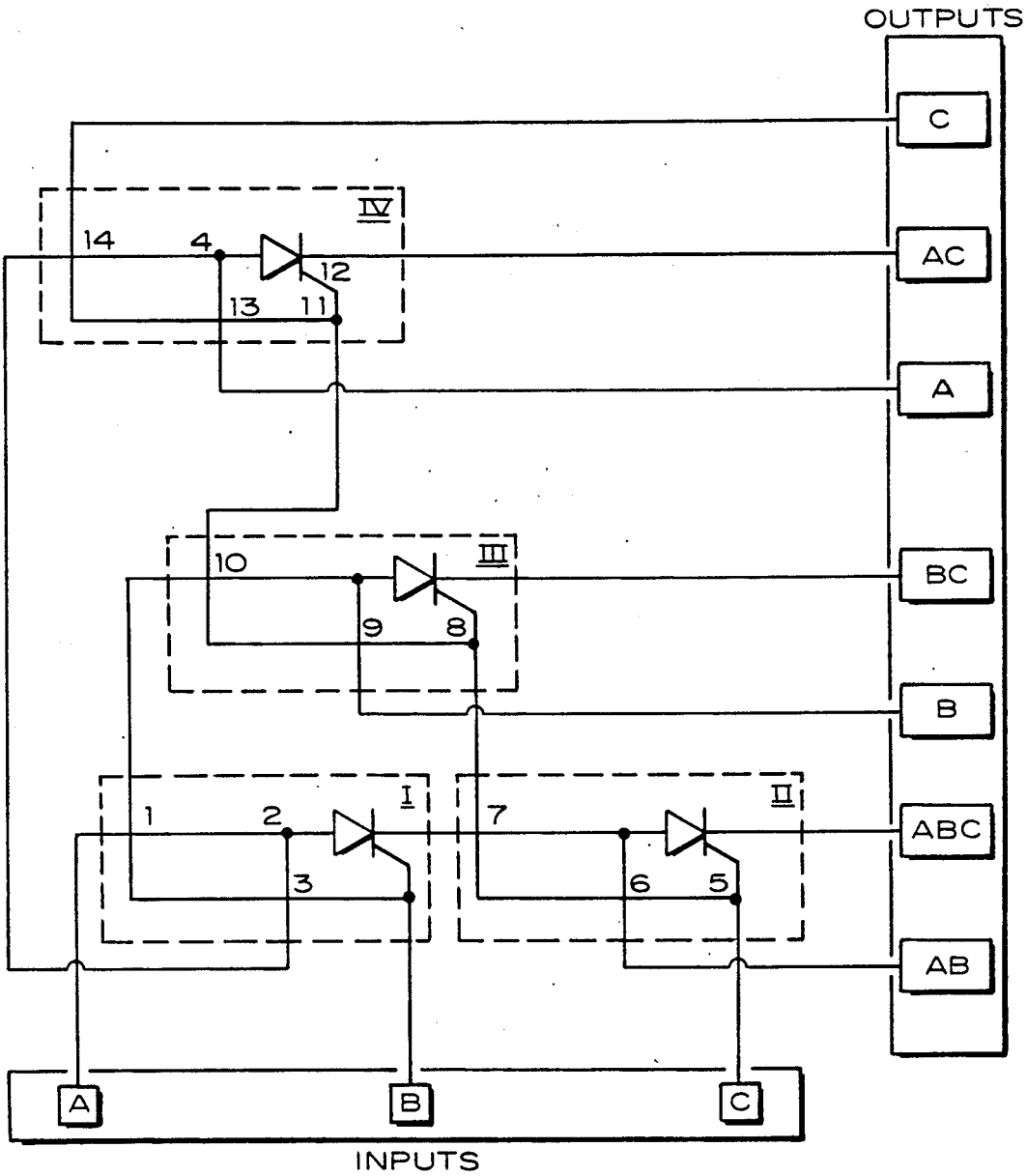
FIG. 10 shows a schematic representation of a three-input-seven-output logic element.

A three input-seven output logic element as shown schematically in FIG. 10 may be constructed by using four AND/NAND logic elements.

For example, if the AC output were desired, simultaneous reactions would be started at inputs A and C. Following the path of the reaction of the input A, it is seen in FIG. 10 that the path would travel across the destructive crossover at 1 and to the branch at 2 where one path would lead to the ungated explosive controlled rectifier and die and the other path would proceed across the destructive crossover at 3 and onto 4 of AND/NAND element IV. Meanwhile, the reaction started at input C would travel to AND/NAND No. II and branch at 5. One branch will gate the explosive controlled rectifier and die while the other branch will proceed across the destructive crossover at 6 and across the destructive crossover at 7 and onto AND/NAND III. The path follows the same pattern as in AND/-NAND II along points 8, 9 and 10 and onto AND/-NAND IV. The path will branch at 11 and continue on to gate the explosive controlled rectifier at 12. The other path will continue across the destructive crossover at 13 and will die at the destructive crossover at 14 which has been previously crossed by path A. Meanwhile, path A will have branched at 4 with one leg proceeding to the previously crossed destructive crossover at 13 and dying while the other path proceeds through the previously gated explosive controlled rectifier and onto output AC.

It is to be noted that to obtain the proper sequencing of events, the explosive paths are designed such that the length of the path divided by the detonation velocity of the explosive gives the desired time delay.

The three input-seven output logic element of FIG. 10 can be employed in an explosive logic network to obtain up to 25 outputs if any combination of five input detonators are utilized up to and including the simultaneous detonation of any three. The total combinations possible are given by:

$$P = \sum_{N=1}^{N=R} \frac{N!}{(N-R)!R!}$$

where

N = total number of inputs

R = number of simultaneous inputs

P = number of outputs or:

$$P = \frac{5!}{(5-3)!3!} + \frac{5!}{(5-2)!2!} + \frac{5!}{(5-1)!} = 25 \text{ outputs}$$

The five input–25 output logic network employed in the initiation system is shown symbolically in FIG. 11. A schematic of the initiation system shown in FIG. 12 includes a block diagram of the explosive logic network and five of its outputs.

Figure 12:
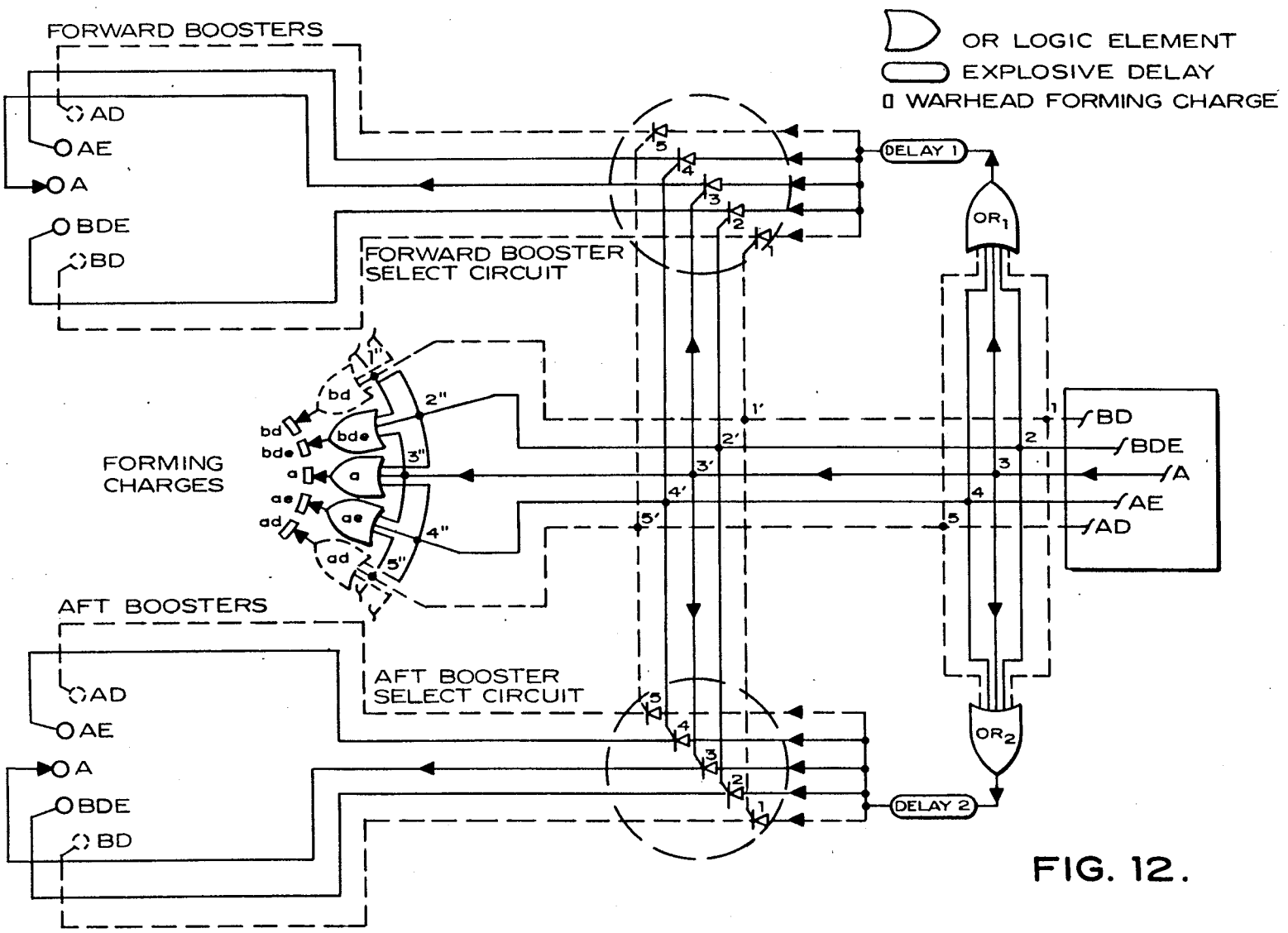
FIG. 12 shows a schematic representation of the warhead initiation system.

Assume that a signal is received by detonator A. From detonator A it follows the path designated by the arrow to give an A output from the explosive logic network. Referring to FIG. 12, the A output propagates on to junction 3. From this point the reaction branches in three directions: One to $OR_1$ and one to $OR_2$ (forward and aft respectively), and the third to junction 3'. The outputs of the two OR elements go to explosive delay elements 1 and 2 located on each end of the warhead. The explosive delay elements consist of a spiral explosive path of appropriate length for the proper time delay.

The circuit branches again at junction 3'. From 3' it propagates to explosive control rectifier 3 in both the forward and aft booster select circuits, thus gating these two explosive controlled rectifiers. The third branch from 3' travels to junction 3''. From 3'' it goes to OR elements a, bde, and ae which are part of the forming charge select circuit. These three OR element outputs initiate forming charges a, bde and ae. Having allowed sufficient time for the warhead to deform, the output of Delay 1 and Delay 2 propagates to each ECR in the booster select circuits. Only ECR 3 in each circuit has been gated and therefore only these two paths propagate beyond their ECR's. The explosive reaction then proceeds to Booster A on each end of the warhead, initiating the two boosters simultaneously.

Figure 13:
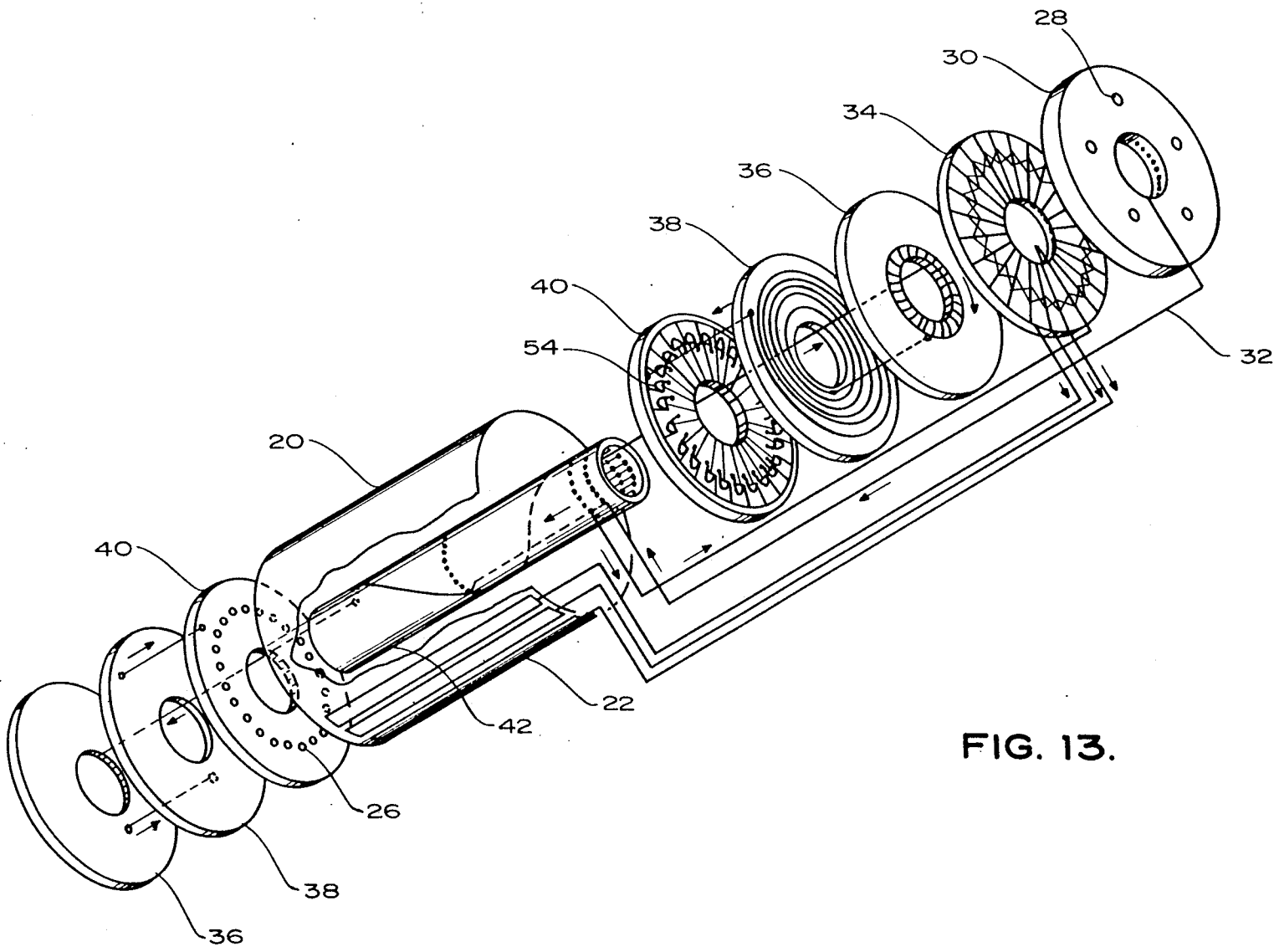
FIG. 13 shows an exploded view in perspective of the selectively aimable warhead initiation system.

The selectively aimable warhead initiation system is shown physically in FIG. 13. The system performs two separate functions, namely, warhead forming and warhead initiation. Information from the target detecting device of the guided missile, by process of binary selection, delivers electrical signals to selected detonator inputs 28 of the explosive logic network 30. An explosive output 32 in the desired sector is sent from the explosive logic network. This output is fed into the forming charge select circuit 34 which selects and initiates the forming charges. This same output 32 from the explosive logic network is also used to select and initiate the desired boosters 26 at the fore and aft ends of the warhead. This is done with the multi-input OR circuit 36, explosive delay line 38, and the booster select circuit 40. Transfer of the detonation signal 32 from the explosive logic network to the other circuit is accomplished with the helix-detonation transfer line 42.

The sequence for warhead shaping and initiation is as follows:

The logic network explosive output 32 is accepted by the helix-detonation transfer line 42.

The transfer line 42 is a plastic or silicon rubber tube with explosive paths on its inner and outer surfaces. It is located in the central hole 44 of warhead 20.

The logic network output 32 is then explosively transferred down one of the inside paths of the helix-detonation transfer line where it divides as indicated by the arrows. One path goes to the forming charge select circuit 34 and the other path continues to the midpoint on the inside of the tube.

Figure 14:
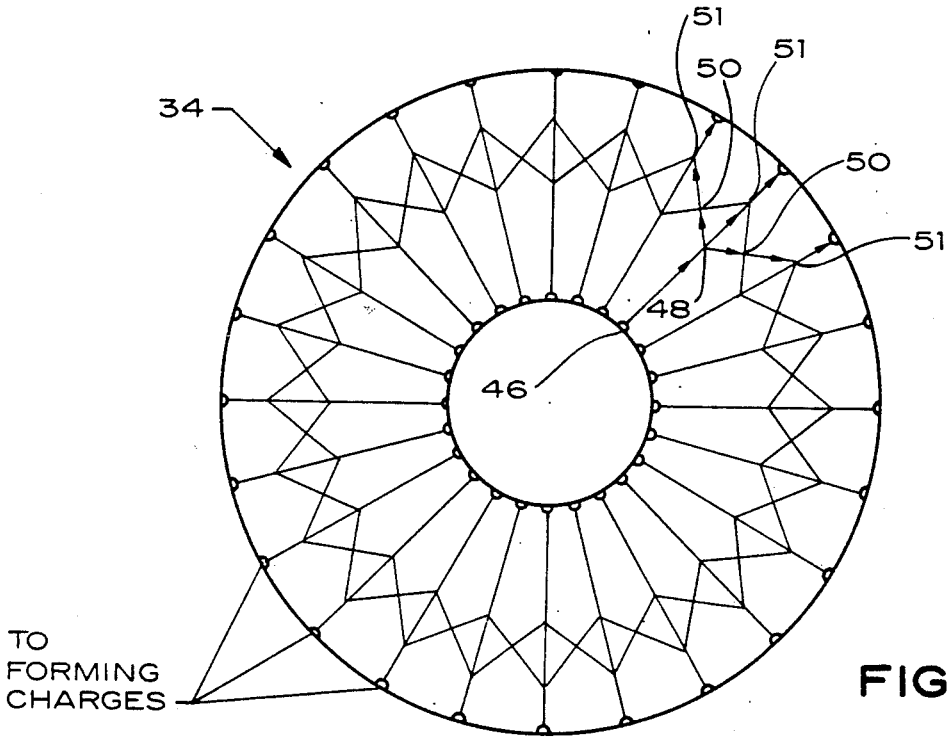
FIG. 14 shows the forming charge select circuit in a schematic representation.

The detonation path is transferred to the appropriate forming charge select circuit input 46 as shown in detail in FIG. 14. The explosive trail then divides at a three way branch 48, propagating to three forming charges as shown in FIG. 13.

Adjacent the three way branch, the two outside explosive trails pass through destructive crossovers 50. The destructive crossovers prevent back detonation to the adjacent three way branches.

The three branches propagate into three three-input OR circuits 51 which then transfer the detonation to the forming charges to begin warhead shaping. Meanwhile the explosive path in the helix-detonation transfer line has propagated to the midpoint of the tube, and having transferred to the outside of the tube, initiates one of the twenty-four helical explosive paths. The helical explosive path then propagates in opposite directions from the midpoint to the outputs on either end. The outputs are diametrically opposite the input.

The outputs of the helix performs two functions:

First, the explosive delay lines 38 on each end are initiated via the multi-input OR circuit 36 located on each end.

Figure 15:
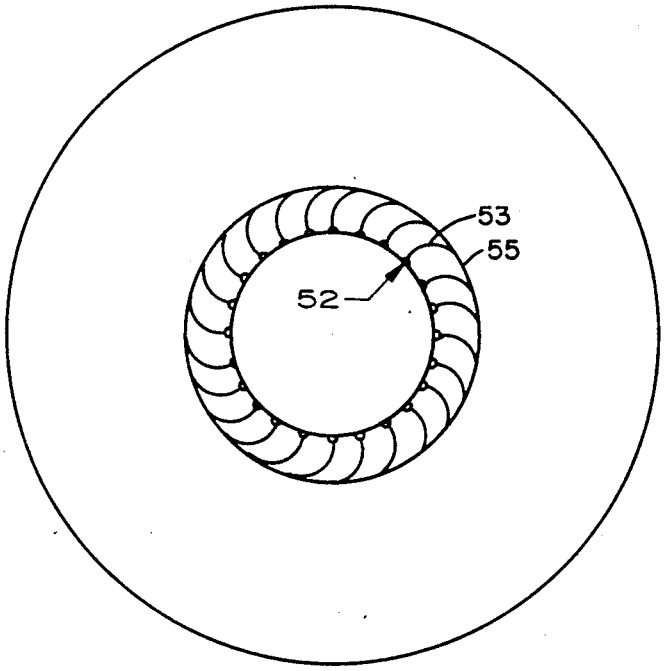
FIG. 15 shows the multi-input OR circuit in schematic form.
Figure 16:
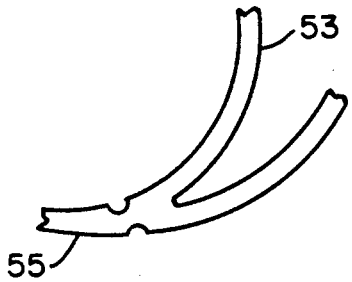
FIG. 16 shows an OR element of the multi-input OR circuit in detail.

The multi-input OR circuits comprise a series of connected OR elements from any one of the twenty-four inputs 52, thus preventing back detonation to the remaining twenty-three helix explosive channels. The detonation wave will travel from the inner circle which is the locus of the 24 inputs 52 from any one of the inputs along a leg 53 of its respective OR gate to the outer perimeter 55 of the explosive path continuing in a clockwise direction until it reaches an output point located somewhere along the path. The output of the multi-input OR elements goes directly to the time delay inputs. FIG. 16 shows in detail an OR element as employed in the multi-input OR circuit of FIG. 15.

Secondly, the two correct explosive control rectifiers 54 and booster select circuits 40 are gated.

After a sufficient time delay, in the order of one-half to one millisecond, to allow for proper shaping of the warhead, the output from each of the two delay lines goes into the booster select circuits 40 and initiate the paths leading to the twenty-four explosive rectifiers 54 on each end. Only that explosive control rectifier on each end of the warhead which has been gated, will allow the detonation to pass to the selected booster for definitive warhead detonation.

The explosive circuits used in this system can be fabricated by photo-etching the explosive paths in metal or molding the paths in plastic. These paths are then hydrostatically loaded with a secondary explosive material such as PBXC-303.

What is claimed is:

1. In a weapon system having a cylindrical, formable warhead and means for outputting target signals based on target encounter geometry;

a selectively aimable warhead initiation system comprising:

a circuit of explosive trails;

a plurality of warhead forming charges;

explosive logic network means for receiving said target signals and producing a single detonation signal along one of a plurality of explosive trails extending from said network means;

said plurality of explosive trails being equal in number to said plurality of forming charges;

a plurality, equal in number to said plurality of warhead forming charges, of first two way branches wherein said explosive trails branch into first and second explosive trails;

said first explosive trail extending to a forming charge select circuit wherein said first trail branches into third, fourth and fifth explosive trails;

said third explosive trail extending through a first OR explosive logic element and to a first warhead forming charge which has been pre-selected by said target signal outputting means;

said fourth and fifth explosive trails extending to the second and third OR explosive logic elements, respectively, and then to second and third warhead forming charges, respectively;

said second and third forming charges being the nearest neighbors of said first forming charge;

said second plurality of explosive trails extending coaxial with, and along the inner surface of, and from the forward end of a cylindrical helix-detonation transfer line towards the middle of said transfer line and then extending through a plurality, equal in number to said plurality of forming charges, of holes and to a second plurality, equal in number to said plurality of forming charges, of two way branches;

said plurality of explosive trails extending from said plurality of two-way branches along a plurality of helical paths located on the surface of said transfer line to a position on the fore and aft ends of said transfer lines;

the ends of said helical trails being diametrically opposite each other;

each of said plurality of helical paths extending from the fore and aft end of said transfer line to respective booster select explosive circuits, wherein a preselected one of a plurality, equal in number to said plurality of warhead forming charges, of explosive control rectifier can be gated;

said helical trails extending from the fore and aft ends of said transfer line extending also to respective multi-input OR circuits and through respective explosive delay lines and to said respective booster select explosive circuits, wherein said two explosive trails branch into a first and second plurality of explosive trails equal in number to said plurality of forming charges, each trail extending to one of said plurality of explosive controlled rectifiers, only one of which can be gated;

said first and second plurality of explosive trails then extend to a plurality of forward and plurality of aft boosters, respectively, said plurality of boosters being equal in number to said plurality of forming charges;

whereby said warhead may be formed by the simultaneous detonation of one of said forming charges and its two nearest neighbors and subsequently detonated by the simultaneous detonation of one forward booster and one aft booster located diametrically opposite said forming charges.

2. In a weapon system having means for outputting signals based on target encounter geometry and a cylindrical, formable warhead, a selectively aimable warhead initiation system comprising:

a plurality of detonation modes; and logic means for sequentially detonating certain of said modes in a pattern determined by said signals;

a plurality of warhead forming charges;

a plurality of warhead booster charges; and said forming and booster charges being adjacent said selectively aimable warhead;

means for detonating selected booster charges; and means for delaying detonation of said selected booster charges until after detonation of said selected forming charges;

means for detonating selected forming charges comprising:

a plurality of explosive trails equal in number to said plurality of forming charges;

each of said trails being straight and of equal length;

the initial point of each trail lying in a common first circle;

the terminal point of each trail lying in a common second circle;

said circles being concentric and coplanar;

said second circle being greater in diameter than said first circle by the length of said trails;

branch points on each of said trails lying in a third concentric circle;

the diameter of said third circle being intermediate of the diameters of said first and second circles;

branches extending from said branch points away from said first circle to the two nearest neighbors of said trails;

each of said branches and the respective trail to which said branches lead being connected to inputs to a multi-input OR element.

3. In a weapon system having means for outputting signals based on target encounter geometry and a cylindrical, formable warhead, a selectively aimable warhead initiation system comprising:

(a) a plurality of detonation modes comprising:

a plurality of warhead forming charges;

a plurality of warhead booster charges; and said forming and booster charges being adjacent said selectively aimable warhead;

(b) logic means for sequentially detonating certain of said modes in a pattern determined by said signals comprising:

means for detonating selected forming charges;

means for detonating selected booster charges;

means for delaying detonation of said selected booster charges until after detonation of said selected forming charges;

whereby said warhead is properly formed prior to detonation of said booster charges;

said forming charges and said booster charges being evenly spaced about the circumference of a round warhead;

said booster charges and said forming charges being equal in number; and means for selecting a booster charge located on a portion of said warhead diametrically opposite said forming charge to be detonated comprising:

a helix detonation transfer line comprising:

a cylinder;

first, second and third pluralities of hole defining walls;

each of said pluralities of holes defining walls being equal in number to said plurality of forming charges;

each of said three pluralities of hole defining walls being evenly spaced around a circumference of said cylinder;

said first and second plurality of hole defining walls being located at the forward end of said cylinder;

said first plurality of hole defining walls being nearer the forward end of said cylinder;

said third plurality of hole defining walls being located at the center of said cylinder;

a plurality of straight, non-overlapping explosive trails equal in number to said plurality of forming charges; and being located on a surface of said cylinder;

each trail of said plurality of explosive trails being associated with one hole defining wall from each of said pluralities of hole defining walls and connecting said three hole defining walls in an essentially straight line;

a plurality of helical, non-overlapping explosive trails equal in number to said plurality of forming charges and being located on a surface of said cylinder opposite the surface on which said plurality of straight explosive trail are located;

each of said helical trails being associated with one hole defining wall of said third plurality of hole defining wall and being connected to one of said straight trails; and each of said plurality of helical trails extending from its associated hole defining wall of said third plurality of hole defining walls to each end of said cylinder and half way around said cylinder;

whereby a detonation entering said helix detonation transfer line exits said transfer line at a point diametrically opposite the point where it enters.

* * * * *